US008031123B2

(12) United States Patent
Morita

(10) Patent No.: US 8,031,123 B2
(45) Date of Patent: Oct. 4, 2011

(54) ANTENNA AND RADIO COMMUNICATION APPARATUS

(75) Inventor: Atsushi Morita, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 345 days.

(21) Appl. No.: 12/369,149

(22) Filed: Feb. 11, 2009

(65) Prior Publication Data

US 2009/0146905 A1 Jun. 11, 2009

Related U.S. Application Data

(63) Continuation of application No. PCT/JP2008/052516, filed on Feb. 15, 2008.

(30) Foreign Application Priority Data

Mar. 29, 2007 (JP) ..... 2007-087106

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,610,619 | A | 3/1997 | Zafar | |
| 6,323,811 | B1 | 11/2001 | Tsubaki et al. | |
| 7,026,999 | B2 * | 4/2006 | Umehara et al. | 343/702 |
| 7,256,743 | B2 * | 8/2007 | Korva | 343/702 |
| 2002/0196192 | A1 | 12/2002 | Nagumo et al. | |
| 2004/0108957 | A1 | 6/2004 | Umehara et al. | |
| 2006/0152411 | A1 | 7/2006 | Iguchi et al. | |

FOREIGN PATENT DOCUMENTS

| | | |
|---|---|---|
| JP | 11-127014 | 5/1999 |
| JP | 2002-50919 | 2/2002 |
| JP | 2003-8326 | 1/2003 |
| JP | 2004-201278 | 7/2004 |
| JP | 2005-64945 | 3/2005 |
| WO | WO 01/24316 | 4/2001 |
| WO | WO 2004/109857 | 12/2004 |

OTHER PUBLICATIONS

Written Opinion with English Language Translation.
International Search Report with English Language Translation.
Official Communication issued in corresponding European Patent Application No. 08711346.0, mailed on Apr. 7, 2010.
Official Communication issued in corresponding European Patent Application No. 08 711 346.0, mailed on Apr. 15, 2011.

* cited by examiner

*Primary Examiner* — Hoang V Nguyen
(74) *Attorney, Agent, or Firm* — Keating & Bennett, LLP

(57) ABSTRACT

A feeding radiation electrode and a non-feeding radiation electrode are provided extending from a front side surface to top surface of a dielectric base. In the feeding radiation electrode, a slit that extends from a feeding end in an inward direction is formed, and, in the non-feeding radiation electrode, a slit that extends from a ground end in an inward direction is formed. In addition, on the non-feeding radiation electrode, a branch electrode is formed so as to extend toward the side of the feeding radiation electrode. With this configuration, gain is obtained in two frequency bands by using a multi-resonance of fundamental wave resonances and harmonic resonances generated by the feeding radiation electrode and the non-feeding radiation electrode, and a good return loss characteristic caused by coupling of harmonic resonances is provided. In other embodiments, the feeding and non-feeding radiation electrodes may be formed on a flat substrate, or directly on a circuit board.

8 Claims, 4 Drawing Sheets

ANTENNA AND RADIO COMMUNICATION APPARATUS

CROSS-REFERENCE TO RELATED APPLICATIONS

This is a continuation under 35 U.S.C. §111(a) of PCT/JP2008/052516 filed Feb. 15, 2008, and claims priority of JP2007-087106 filed Mar. 29, 2007, both incorporated by reference.

BACKGROUND

1. Technical Field

This disclosure relates to an antenna for use in a radio communication apparatus such as a mobile communication apparatus, and a radio communication apparatus provided with the antenna.

2. Background Art

Patent Documents 1 and 2 disclose antennas for use in plural frequency bands in radio communication apparatuses such as terminal devices (cellular phones) of a cellular phone system. FIG. 1 is a perspective view of the antenna described in Patent Document 1. In FIG. 1, a radiation electrode 12, and non-feeding electrodes 13 and 14 are formed on a top surface of a dielectric base 11. In addition, a ground electrode 15 is formed on substantially the entirety of a bottom surface of the dielectric base 11 so that an excitation conductor 19 does not touch the ground electrode 15. Further, ground conductors 16, 17, and 18, for respectively grounding the radiation electrode 12 and the non-feeding electrodes 13 and 14, are formed on a side surface of the dielectric base 11.

As described above, by forming a radiation electrode, and a plurality of non-feeding electrodes having resonant frequencies close to that of the radiation electrode on the same plane, and combining a plurality of resonances, an antenna having wideband characteristics is realized.

In addition, Patent Document 2 indicates that an antenna having gain in two frequency bands is configured by using a multi-resonance of fundamental wave resonances and harmonic resonances generated by a feeding electrode and a non-feeding electrode. Specifically, by forming spiral slits in the feeding electrode and the non-feeding electrode, a resonant frequency of a harmonic resonance (higher mode) can be set to a desired frequency almost without changing a frequency of a fundamental wave resonance (fundamental mode).

Patent Document 1: Japanese Unexamined Patent Application Publication No. 11-127014

Patent Document 2: Japanese Unexamined Patent Application Publication No. 2003-8326

As indicated by Patent Document 2, by providing slits on a feeding electrode and a non-feeding electrode, a resonant frequency of a harmonic can be controlled. However, depending on a combination of a resonant frequency of a fundamental wave and a resonant frequency of a harmonic, matching is frequently not established at the resonant frequency of the harmonic. Accordingly, an optimal return loss may not be obtained. In other words, considering capacitive coupling between the feeding electrode and the non-feeding electrode, as the length of the slit formed in each of the feeding electrode and the non-feeding electrode increases, inductance functionality increases and capacitance functionality decreases. Accordingly, the amount of coupling of harmonic resonances between the feeding electrode and the non-feeding electrode is reduced, so that a problem occurs in that a desired gain cannot be obtained since a return loss at a harmonic resonant frequency is large.

SUMMARY

Accordingly, the present inventor has developed an antenna that has gain in two frequency bands by using a multi-resonance comprised of fundamental wave resonances and harmonic resonances generated by a feeding radiation electrode and a non-feeding radiation electrode, and that has a good return loss characteristic generated by coupling of the harmonic resonances, and a radio communication apparatus provided with the antenna.

To solve the problem, is the antenna may be configured as follows.

An antenna comprising: a feeding radiation electrode that has one end serving as a feeding point and the other end serving as an open end, thereby serving as substantially a quarter wavelength feeding radiation electrode in an operating frequency range; and a non-feeding radiation electrode that has one end serving as a ground end and the other end serving as an open end; said feeding and non-feeding radiation electrodes being formed on a base formed of a material selected from either a dielectric material or a combination of dielectric and magnetic material; wherein the feeding radiation electrode and the non-feeding radiation electrode are disposed on the base with a predetermined distance provided therebetween, and a branch electrode is formed on the base so as to extend from the non-feeding radiation electrode toward the feeding radiation electrode; whereby said antenna has at said operating frequency range a multi-resonance comprised of fundamental resonances and harmonic resonances generated by the feeding radiation electrode and the non-feeding radiation electrode.

In the antenna, the feeding radiation electrode may extend two-dimensionally on said base, and a spiral or partially spiral slit is formed therein, thereby setting an electrical length from the feeding point to the open end of the feeding radiation electrode; and the non-feeding radiation electrode extends two-dimensionally on said base, and a spiral or partially spiral slit is formed therein, thereby setting an electrical length from the ground end to the open end of the non-feeding radiation electrode.

A radio communication apparatus having the antenna further comprises a radio communication circuit that is connected to said feeding point for feeding a radio communication signal in said operating frequency range to said feeding radiation electrode.

In the radio communication apparatus having the antenna, said base may be a dielectric block, with said electrodes formed on two sides of said dielectric block, or a flat substrate, or a circuit board.

The branch electrode preferably extends substantially parallel to said feeding radiation electrode at a predetermined distance therefrom, and the branch electrode preferably extends from a portion of said non-feeding radiation electrode near said ground end.

According to this disclosure, a branch electrode shorter than a non-feeding radiation electrode is formed so as to extend from the non-feeding radiation electrode toward the feeding radiation electrode, whereby capacitance generated between this branch electrode and the feeding radiation electrode increases the strength of coupling of harmonic resonances of the non-feeding radiation electrode and the feeding radiation electrode, whereby a return loss in an operating frequency band that is generated by a multi-resonance of harmonic resonances can be reduced.

In addition, by forming a spiral slit in each of a feeding radiation electrode and a non-feeding radiation electrode, which extend two-dimensionally, a harmonic resonant frequency can be set to a desired frequency while maintaining a fundamental resonant frequency to be substantially constant. Even if there is a reduction of the amount of coupling of harmonic resonances generated by the feeding radiation electrode and the non-feeding radiation electrode, caused by increasing the length of the slit in order to lower the harmonic resonant frequency, a desired return loss characteristic at the harmonic resonant frequency can still be obtained by providing the branch electrode. Thus, flexibility of combining the fundamental wave resonant frequency and the harmonic resonant frequency is enhanced.

Other features and advantages will become apparent from the following description of embodiments, which refers to the accompanying drawings.

DETAILED DESCRIPTION

Reference Numerals

Figure 1:
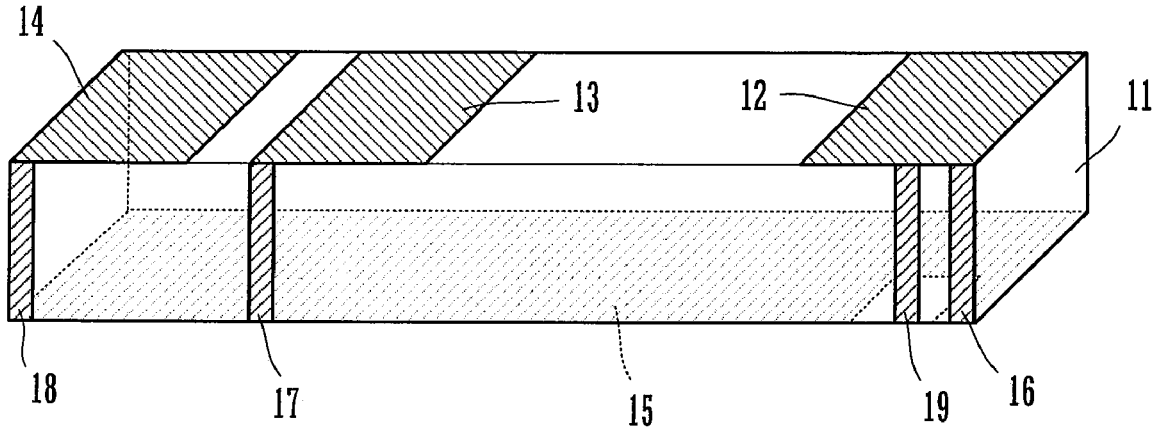
FIG.1 PRIOR ART
FIG. 1 is an illustration showing the configuration of the antenna shown in Patent Document 1.

20 base
21, 31 feeding radiation electrodes
22, 32 non-feeding radiation electrodes
23, 24, 33, 34 slits
25, 35 feeding ends
26, 36 ground ends
27, 37 branch electrodes
30 substrate
40 feeding means
101, 102 antennas

First Embodiment

An antenna according to a first embodiment and a radio communication apparatus will be described with reference to FIGS. 2A, 2B, 3A and 3B.

Figure 2A:
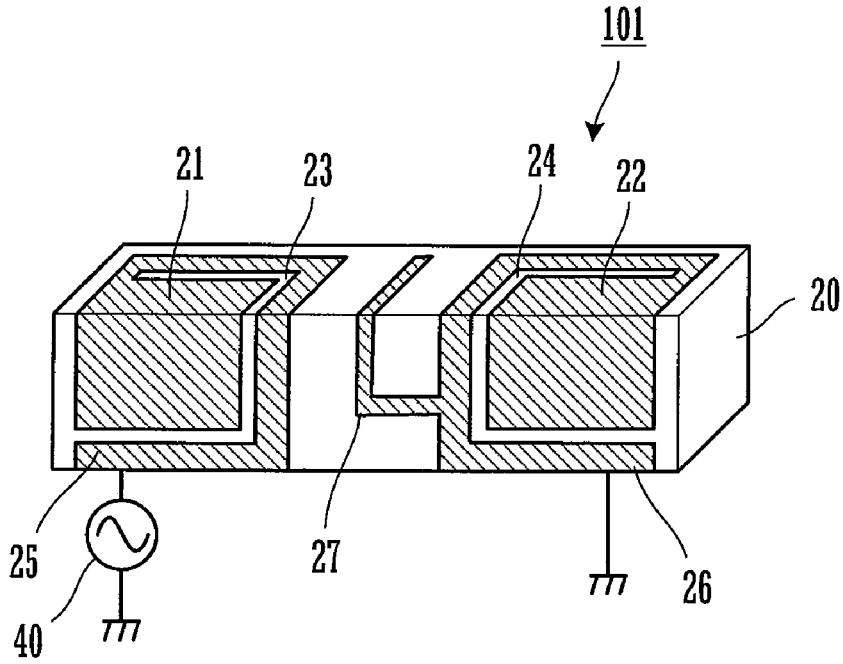
FIGS. 2A and 2B are, respectively, perspective views of an antenna according to a first embodiment, and an antenna as a comparative example therefore.
Figure 2B:
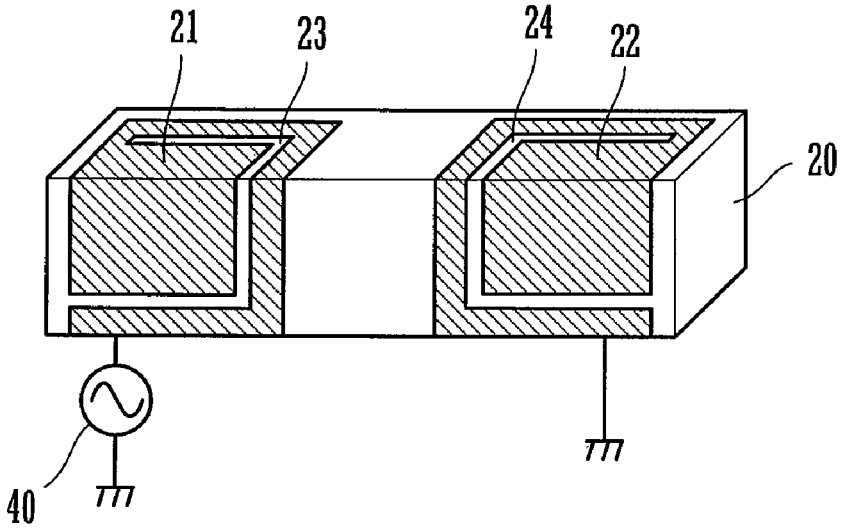
FIG.2B PRIOR ART

FIG. 2A is a perspective view of the antenna according to the first embodiment, and FIG. 2B is a perspective view of an antenna as a comparative example therefore.

As shown in FIG. 2A, the antenna 101 according to the first embodiment has a feeding radiation electrode 21 and a non-feeding radiation electrode 22 that each two-dimensionally extend from the front side surface (as seen in the figure) to a top surface of a parallelepiped dielectric base 20. A material of the dielectric base 20 is a compound dielectric material including a dielectric inorganic filler and an organic polymer material, or a combination of a dielectric material and a magnetic material.

Examples of the dielectric inorganic filler are high dielectric constant ceramics such as calcium titanate and titanium oxide.

An example of the organic polymer material is polypropylene.

Further, a high dielectric constant material having relative magnetic permeability of more than 1.0 can be used as said combination of the dielectric material and the magnetic material.

In the feeding radiation electrode 21 and the non-feeding radiation electrode 22, spiral and partially spiral slits 23 and 24 are formed. The slit 23 formed in the feeding radiation electrode 21 extends from a feeding end (corresponding to a feeding point) 25 in an inward direction, and the slit 24 formed in the non-feeding radiation electrode 22 extends from a ground end 26 in an inward direction. With this configuration, the feeding radiation electrode 21 which has one end serving as a feeding point and the other end serving as an open end and which has substantially a quarter wavelength of a fundamental wave in an operating frequency range, and the non-feeding radiation electrode 22 which has one end serving as a ground end and the other end serving as an open end are formed.

As described above, by respectively providing the slits 23 and 24 in the feeding radiation electrode 21 and the non-feeding radiation electrode 22, which extend two-dimensionally, an electrical length from the feeding end to the open end of the feeding radiation electrode is set, and, in addition, an electrical length from the ground end to the open end of the non-feeding radiation electrode 22 is set. With this structure, a resonant frequency of harmonic resonance (higher mode) can be set to a desired frequency while not changing a frequency of a fundamental wave resonance (fundamental mode). In other words, a fundamental wave frequency and a harmonic wave frequency can be set independently from each other. The principle is as disclosed in Patent Document 2.

A branch electrode 27 is formed extending from the non-feeding radiation electrode 22 and toward the side of the feeding radiation electrode 21. In this example, the branch electrode 27 is formed so as to extend from a side close to the ground end 26 of the non-feeding radiation electrode 22 in a direction away therefrom, whereby the branch electrode 27 is disposed substantially in parallel to an edge of the feeding radiation electrode 21. The branch electrode 27 increases capacitive coupling of harmonic resonances between the non-feeding radiation electrode 22 and the feeding radiation electrode 21. Thus, the branch electrode 27 is formed so as to be shorter than the length (the length along the slit) of the non-feeding radiation electrode 22.

FIG. 2B shows, as a comparative example, an antenna in which the branch electrode 27 shown in FIG. 2A is not formed.

Figure 3A:
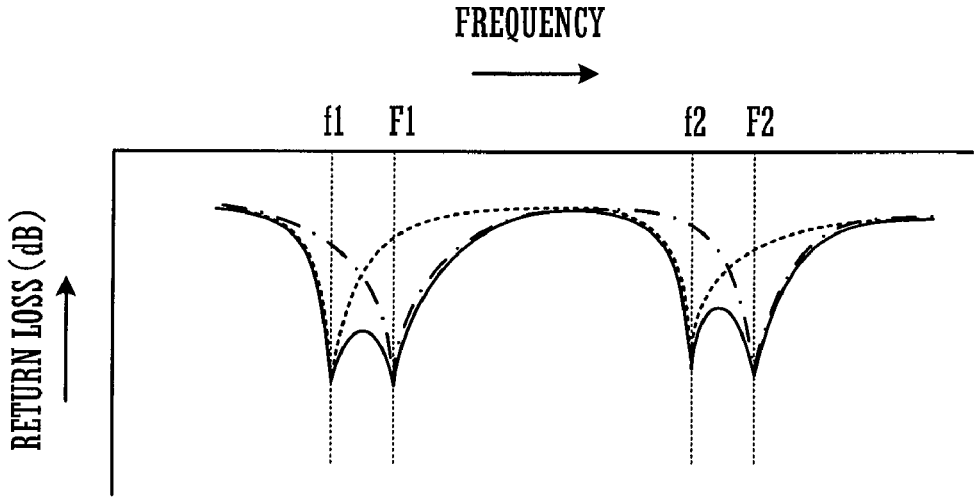
FIGS. 3A and 3B are, respectively, graphs showing frequency characteristics of return losses of the two antennas shown in FIGS. 2A and 2B.
Figure 3B:
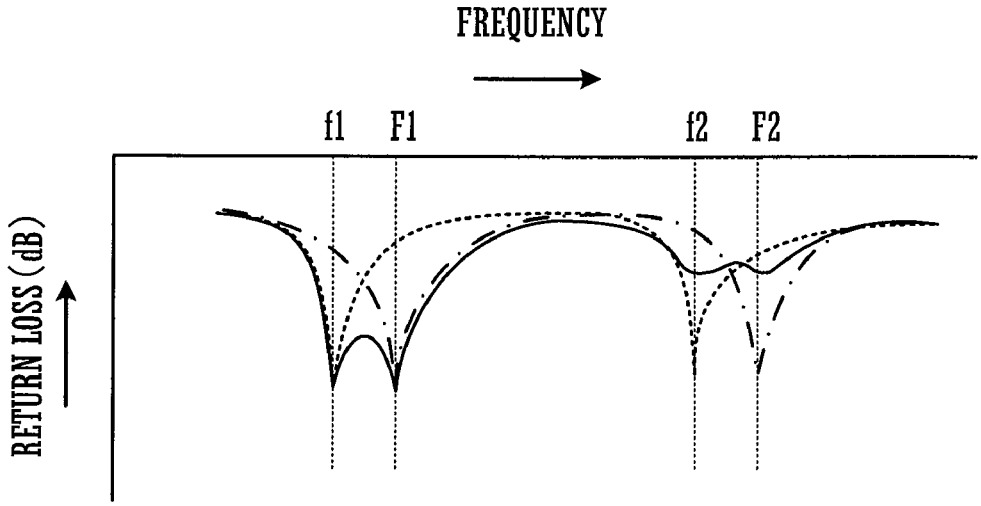

FIGS. 3A and 3B shows frequency characteristics of return losses of the two antennas shown in FIGS. 2A and 2B. FIG. 3A shows a characteristic of return loss of the antenna 101, according to the first embodiment, shown in FIG. 2A. FIG. 3B shows a characteristic of return loss of the antenna shown in FIG. 2B as the comparative example.

In FIGS. 3A and 3B, F1 denotes a fundamental wave resonant frequency generated by the feeding radiation electrode 21, and F2 denotes a second harmonic resonant frequency generated by the feeding radiation electrode 21. In addition, f1 denotes a fundamental wave resonant frequency caused by the non-feeding radiation electrode 22, and f2 denotes a second harmonic resonant frequency caused by the non-feeding radiation electrode 22.

In addition, the alternate dash and dot line indicates a frequency characteristic of a return loss of the feeding radiation electrode 21, and the dotted line curve indicates a frequency characteristic of a return loss of the non-feeding radiation electrode 22. Moreover, the solid line curve indicates a characteristic of return loss based on a multi-resonance of fundamental wave resonances and harmonic resonances caused by the feeding radiation electrode 21 and the non-feeding radiation electrode 22.

In FIGS. 3A and 3B, the frequency band of f1-F1 corresponds to CDMA800 (843 to 890 MHz), and the frequency band of f2-F2 corresponds to CDMA2000 (2110 to 2130 MHz). In other words, this antenna operates as a CDMA 800/2000 dual band antenna.

As shown in FIG. 2B, regarding an antenna in which the feeding radiation electrode 21 with the slit 23 formed therein and the non-feeding radiation electrode 22 with the slit 24 formed therein are simply disposed with a predetermined distance provided therebetween, as shown in FIG. 3B, coupling between two harmonic resonances is weak, and a return loss in frequencies f2 to F2 does not sufficiently decrease. Conversely, as shown in FIG. 3A, in the first embodiment shown in FIG. 2A, the amount of coupling between harmonic resonances is sufficiently strong, so that the multi-resonance can be used.

Second Embodiment

Figure 4:
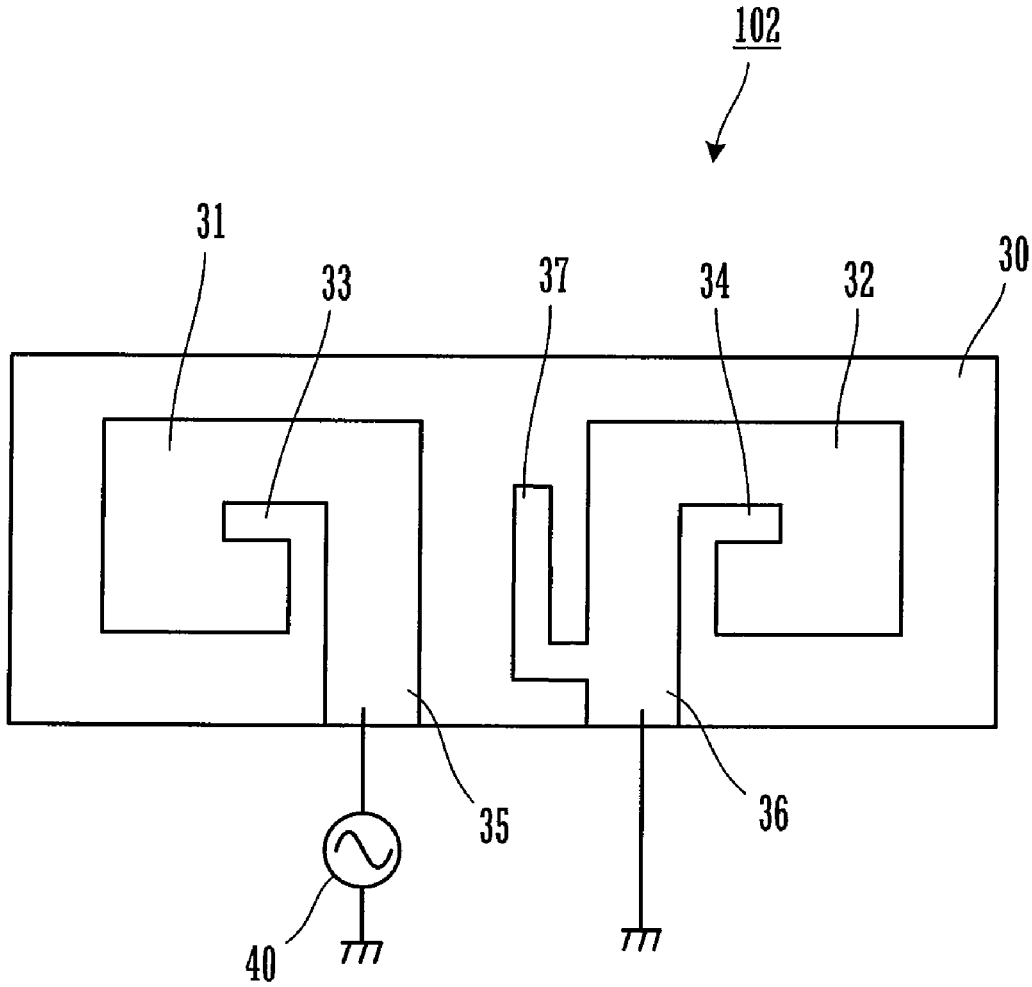
FIG. 4 is a plan view of antenna according to a second embodiment.

FIG. 4 is a plan view of an antenna 102 according to a second embodiment.

Although, in the first embodiment, the various types of electrodes are formed on two sides of a parallelepiped dielectric base, in the second embodiment, the electrodes are formed on a substrate. In FIG. 4, on a top surface of a substrate 30, a feeding radiation electrode 31 and a non-feeding radiation electrode 32 that extend two-dimensionally are provided. In the feeding radiation electrode 31 and the non-feeding radiation electrode 32, spiral slits 33 and 34 are respectively formed. The slit 33 formed in the feeding radiation electrode 31 extends from a feeding end 35 in an inward direction, and the slit 34 formed in the non-feeding radiation electrode 32 extends from a ground end 36 in an inward direction.

A branch electrode 37 is formed from the non-feeding radiation electrode 32 toward the side of the feeding radiation electrode 31. In this example, the branch electrode 37 is formed so as to extend from a side close to the ground end 36 in a direction away therefrom, whereby the branch electrode 37 is disposed substantially in parallel to an edge of the feeding radiation electrode 31.

A material of said substrate 30 is a compound dielectric material including a dielectric inorganic filler and an organic polymer material, or a combination of a dielectric material and a magnetic material.

Examples of the dielectric inorganic filler are high dielectric constant ceramics such as calcium titanate and titanium oxide.

An example of the organic polymer material is polypropylene.

Further, a high dielectric constant material having relative magnetic permeability of more than 1.0 can be used as said combination of the dielectric material and the magnetic material.

As described above, by providing the branch electrode 37, the coupling capacitance between the feeding radiation electrode 31 and the non-feeding radiation electrode 32 is increased to ensure a sufficient amount of coupling of harmonic resonances, so that multi-resonance can be used.

Third Embodiment

A radio communication apparatus such as a cellular phone is configured in the following manner by using the antennas shown in the first and second embodiments.

For example, in the case of using the antenna 101 shown in FIG. 2, a radio communication circuit including a radio-frequency generating and feeding means 40 is provided on a circuit board, and a non-ground region is provided at an end of the circuit board (not shown). The antenna 101 is surface-mounted in the non-ground region. This makes it possible to configure a cellular phone for CDMA800/2000.

In addition, in the case of using the antenna 102 shown in FIG. 4, the antenna 102 including the substrate 30 is surface-mounted in the non-ground region of the circuit board (not shown), or each pattern of the antenna 102 is directly formed on the circuit board without being formed on a substrate 30.

Although particular embodiments have been described, many other variations and modifications and other uses will become apparent to those skilled in the art. Therefore, the present invention is not limited by the specific disclosure herein.

What is claimed is:

1. An antenna comprising:

a feeding radiation electrode including one end defining a feeding point and another end defining an open end, the feeding radiation electrode defining substantially a quarter wavelength feeding radiation electrode constructed to operate in an operating frequency range; and a non-feeding radiation electrode including one end defining a ground end and another end defining an open end;

said feeding and non-feeding radiation electrodes being disposed on a base made of a material selected from either a dielectric material or a combination of dielectric and magnetic material; wherein the feeding radiation electrode and the non-feeding radiation electrode are arranged on the base with a predetermined distance provided therebetween, and a branch electrode is provided on the base so as to extend from the non-feeding radiation electrode toward the feeding radiation electrode along a line that intersects a portion of the feeding radiation electrode; and said antenna has, at said operating frequency range, a multi-resonance including fundamental resonances and harmonic resonances generated by the feeding radiation electrode and the non-feeding radiation electrode.

2. The antenna according to claim 1, wherein the feeding radiation electrode extends two-dimensionally on said base, and a spiral or partially spiral slit is provided therein, thereby setting an electrical length from the feeding point to the open end of the feeding radiation electrode; and the non-feeding radiation electrode extends two-dimensionally on said base, and a spiral or partially spiral slit is provided therein, thereby setting an electrical length from the ground end to the open end of the non-feeding radiation electrode.

3. A radio communication apparatus having the antenna as set forth in claim 1 or 2, and further comprising a radio communication circuit that is connected to said feeding point and arranged to feed a radio communication signal in said operating frequency range to said feeding radiation electrode.

4. A radio communication apparatus having the antenna as set forth in claim 1 or 2, wherein said base is a dielectric block and said electrodes are disposed on two sides of said dielectric block.

5. A radio communication apparatus having the antenna as set forth in claim 1 or 2, wherein said base is a flat dielectric substrate.

6. A radio communication apparatus having the antenna as set forth in claim 1 or 2, wherein said base is a flat circuit board.

7. A radio communication apparatus having the antenna as set forth in claim 1 or 2, wherein said branch electrode extends substantially parallel to said feeding radiation electrode at a predetermined distance therefrom.

8. A radio communication apparatus having the antenna as set forth in claim 7, wherein said branch electrode extends from a portion of said non-feeding radiation electrode near said ground end.

* * * * *